United States Patent [19]

Lopez-Crevillen et al.

[11] Patent Number: 4,987,738

[45] Date of Patent: Jan. 29, 1991

[54] PARTICULATE TRAP SYSTEM FOR AN INTERNAL COMBUSTION ENGINE

[75] Inventors: Jose M. Lopez-Crevillen, Westland; Surendra Singh, Canton; Arjun D. Tuteja, Novi, all of Mich.

[73] Assignee: General Motors Corporation, Detroit, Mich.

[21] Appl. No.: 428,387

[22] Filed: Oct. 27, 1989

[51] Int. Cl.[5] ..... F01N 3/02

[52] U.S. Cl. ..... 60/286; 60/288; 60/303

[58] Field of Search ..... 60/288, 286, 303, 311; 55/DIG. 30, 466

[56] References Cited

U.S. PATENT DOCUMENTS

| | | | |
|---|---|---|---|
| 4,381,643 | 5/1983 | Stark | 60/303 |
| 4,383,411 | 5/1983 | Riddel | 60/303 |
| 4,419,113 | 12/1983 | Smith | 55/484 |
| 4,481,767 | 11/1984 | Stark | 60/303 |
| 4,502,278 | 3/1985 | Stark | 60/303 |
| 4,503,672 | 3/1985 | Stark et al. | 60/286 |
| 4,558,565 | 12/1985 | Kojima et al. | 60/286 |
| 4,677,823 | 7/1987 | Hardy | 60/274 |
| 4,686,827 | 8/1987 | Wade et al. | 60/286 |

FOREIGN PATENT DOCUMENTS

| | | | |
|---|---|---|---|
| 126017 | 7/1984 | Japan | 60/288 |

*Primary Examiner*—Douglas Hart

*Attorney, Agent, or Firm*—Karl F. Barr, Jr.

[57] ABSTRACT

A particulate trap system for use in the exhaust system of an internal combustion engine has an exhaust conduit with a main branch, a bypass branch, and a diverter valve disposed therebetween for selectively diverting exhaust gas through one of the branches. A particulate filter is disposed within the main branch, and a burner assembly having an outlet disposed upstream of the filter is operable to raise the temperature of the filter to a level sufficient to incinerate particulates thereon. A burner supply conduit extending between the exhaust conduit and the burner, having a metering orifice disposed therein, supplies exhaust air to the burner when the diverter valve closes the main branch and channels the exhaust flow through the bypass branch during the regeneration cycle of the system. A pressure relief valve disposed within the bypass branch maintains substantially constant pressure within the exhaust conduit thereby assuring substantially constant flow of exhaust gas through the metering orifice and into the burner assembly.

8 Claims, 4 Drawing Sheets

PARTICULATE TRAP SYSTEM FOR AN INTERNAL COMBUSTION ENGINE

BACKGROUND OF THE INVENTION

1. Field of the Invention

The present invention relates to a particulate trap system for an internal combustion engine which provides constant flow of exhaust gas to the burner, during regeneration.

2. Description of the Relevant Art

There are many particulate trap oxidizer configurations currently being developed for application to internal combustion engines and, more particularly, to diesel engines which have been criticized as having undesirable particulate emission levels. Systems which have been demonstrated as conceptually feasible generally utilize a burner, which is disposed upstream of a particulate trap, to heat the exhaust gas entering the trap to a temperature required to burn the particulates which have been accumulated on the trap during normal engine operation. These systems generally may require valve assemblies to divert, modulate, or restrict exhaust flow to the burner as well as air-fuel sub-systems to support efficient combustion within the particulate trap. The sub-systems are often required to monitor engine operating conditions such as speed and load in order to vary air-fuel mixtures according to changing exhaust gas flow and temperature, since control of temperature is critical for efficient regeneration and long filter life. As a result, large and complex burner and air fuel systems are often required, resulting in packaging and reliability concerns.

SUMMARY OF THE INVENTION

In accordance with the present invention, an exhaust cleaner and burner system for use with the exhaust system of an internal combustion engine is disclosed. The assembly comprises an exhaust conduit connecting the exhaust system of the engine to the exhaust cleaner system. The conduit has a diverter valve disposed at the outlet end which acts to direct exhaust gas, passing through the conduit, into one of two branches of the system. The first, main branch channels exhaust flow into an exhaust filter where the exhaust gas is passed through a filtering means, such as a ceramic monolith, and subsequently to the remainder of the vehicle exhaust system. In a second orientation, the diverter valve blocks exhaust flow to the filter by channeling the gas through a bypass branch. In this configuration, regeneration of the filter is carried out using a burner attached to the main branch and filter assembly.

The burner is mounted with its outlet upstream of the filter, between the diverter valve and the front face of the filter. The burner has an air-fuel mixture apparatus associated therewith which utilizes a fuel pump for delivery of fuel to a burner injector and an air pump for delivering atomizing air to the injector thereby assuring fuel ignition during regeneration. To minimize the size and complexity of the burner and its associated air-fuel system, a supplemental air source comprising diverted exhaust gas supplies overall combustion air to the burner. The exhaust gas has sufficient oxygen present, especially in a diesel application, to allow complete combustion of burner supplied fuel and dispenses with the necessity of a large blower to supply all required combustion air. The supplemental air source comprises a burner supply conduit which extends between the exhaust conduit, upstream of the diverter valve, and the burner. The burner supply conduit has a metering orifice disposed therein which meters the exhaust flow passing through the orifice pipe to maintain a substantially constant flow rate to the burner. By maintaining a substantially constant exhaust flow rate through the burner during regeneration, systems for varying fuel and atomizing air flow, dependent upon changes in exhaust flow due to widely varying engine conditions, are not required. As a result, a reduction in the size and complexity of the burner and associated control systems is achieved.

Maintaining substantially constant flow of exhaust gas for combustion to the burner can be assured under conditions of varying engine speed and load only if exhaust pressure within the main exhaust conduit, at the inlet of the metering orifice, remains substantially constant. A pressure relief valve is disposed within the bypass conduit and acts to maintain the required pressure. The pressure relief valve comprises a pintle valve, or the like, which closes the path of the exhaust in the bypass conduit during regeneration. The valve increases the pressure within the system to a predetermined level by means of a force applied to it by an adjustable spring, air cylinder, gravitational weight, or other type of load. As the exhaust pressure increases, the force on the valve is overcome and the exhaust flows freely through the bypass. During normal engine operation, the diverter valve is maintained in an opened position allowing exhaust gases to be channeled through the filter means prior to their release to the atmosphere. A computer actuates the diverter valve once a predetermined pressure is reached upstream of the filter which is indicative of an undesirable level of particulate accumulation thereon. The computer, acting on information received from pressure sensors disposed throughout the system, moves the diverter valve to a closed position in which the exhaust gas is channeled through the bypass branch. The fuel pump is actuated to supply fuel to the burner where it is atomized by pressurized air from the air pump and ignited by a spark plug or other ignitor means disposed within the burner. Following ignition, the burning air-fuel mixture combines with the metered exhaust air supply entering the burner through the burner supply conduit. The temperature of the exhaust air supply is raised to a temperature sufficient to incinerate the particulates collected on the filter medium, thereby regenerating the filter. Following the regeneration event, the diverter valve is again actuated to close exhaust flow through the bypass branch and to channel exhaust flow through the filter medium and to the atmosphere.

The present invention provides an exhaust cleaner and burner system having an air-fuel system of reduced size and complexity. The maintenance of a substantially constant exhaust air flow through the burner eliminates the need for a burner with an air-fuel system capable of operating under widely varying exhaust air flow volumes. As a result, durability, reliability, and a minimization of size and complexity of the exhaust cleaner and burner system can be achieved.

Other objects and features of the invention will become apparent by reference to the following description and to the drawings.

DESCRIPTION OF THE PREFERRED EMBODIMENT

Figure 1:
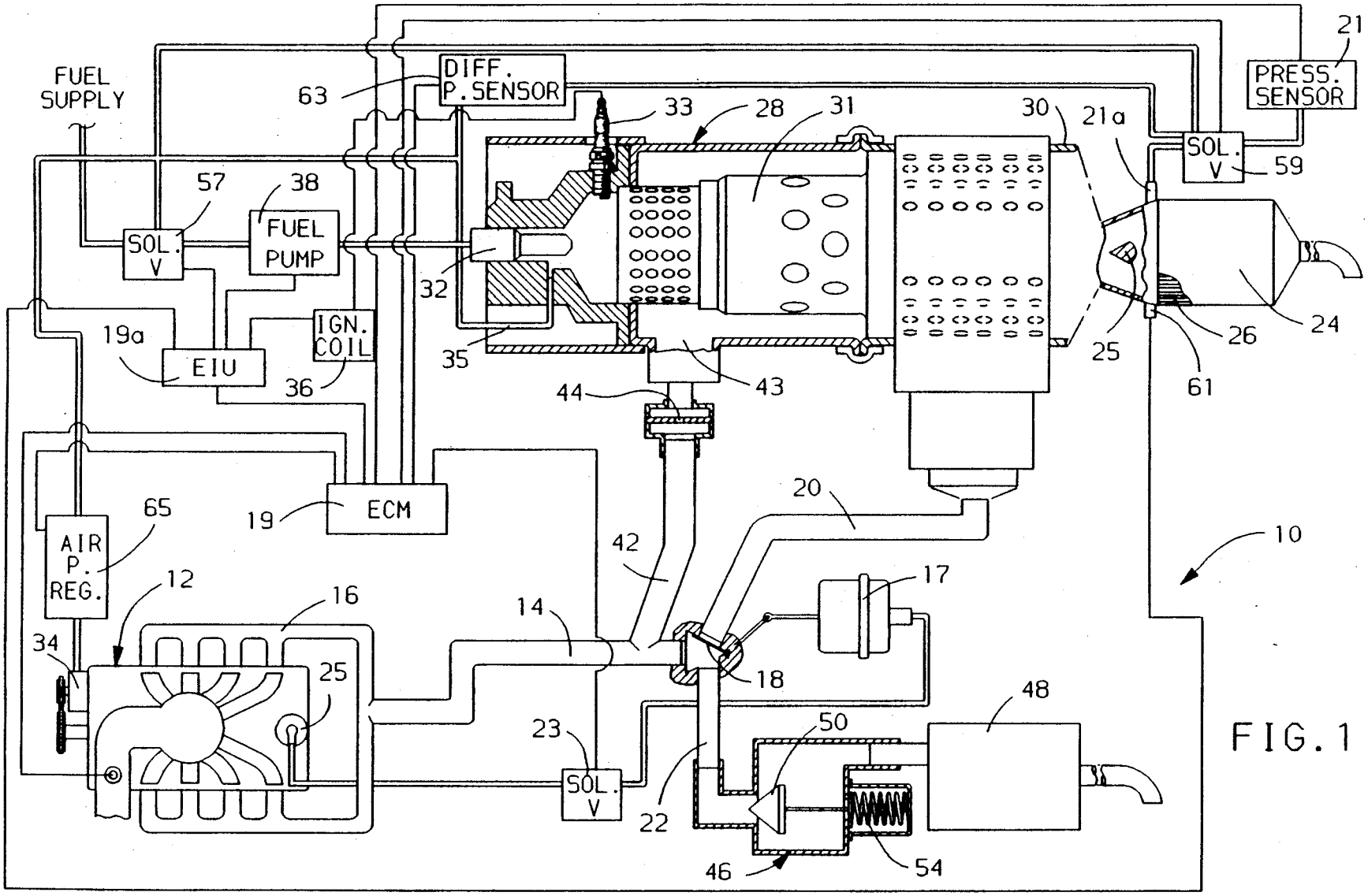
FIG. 1 is a schematic view of one embodiment of an exhaust cleaner and burner system embodying the present invention.

In FIG. 1 there is shown an exhaust cleaner and burner system, designated generally as 10, for use with the exhaust system of an internal combustion engine, such as diesel engine 12, to remove particulates present in the exhaust gas emitted from the engine. The system 10 comprises an exhaust conduit 14 which is connected to the exhaust system 16 of engine 12. A diverter valve 18, operated by an actuator 17, is disposed at the outlet of exhaust conduit 14 for selectively directing exhaust gases from exhaust conduit 14 through a main branch 20 or a bypass branch 22.

When diverter valve 18 is in an opened position, (shown in phantom in FIG. 1) exhaust gas is channeled through main branch 20 and into filter canister 24 where it passes through filter 26 prior to release to the atmosphere. Inlet diffuser 25 acts to uniformly distribute exhaust flow across the inlet face of filter 26 to assure efficient distribution of particulates within the filter. The canister 24 containing filter 26 is generally of a corrosion resistant steel such as stainless steel or other suitable material. Filter 26 is a monolithic or similar filter constructed of porous ceramic, or any other suitable high temperature material, which is capable of collecting minute particulates carried by exhaust gas passing therethrough, while imposing a relatively low exhaust flow restriction to the engine 12. The material has high temperature characteristics which enable it to withstand the thermal stress imposed by repeated regeneration cycles, to be described in further detail below, without a loss of physical integrity or filtration efficiency. Filter 26 is supported within canister 24 utilizing any of several mounting configurations well known in the art.

During operation, particulates are removed from the exhaust gas stream by filter 26 until the pressure upstream of the filter reaches an undesirable level requiring regeneration. An electronic controller, such as Electronic Control Module (ECM) 19, monitors pressure upstream of filter 26 through pressure sensor 21, disposed within sensor tube 21*a*. Upon reaching a predetermined, undesirable pressure condition indicative of the need for filter regeneration, ECM 19 actuates solenoid valve 23 to connect vacuum pump 25 with actuator 17. The actuator 17 operates to close diverter valve 18 and channel exhaust gas through bypass branch 22. To regenerate the filter, a burner is employed to incinerate the trapped particulates. A burner apparatus, designated generally as 28, is mounted with its outlet upstream of filter 26 between diverter valve 18 and the inlet of canister 24. As shown in FIG. 1, the burner apparatus 28 is attached to canister 24 by adapter 30. In addition to acting as a mount for burner apparatus 28, adapter 30 also channels exhaust flow exiting main branch 20 into canister 24.

Burner apparatus 28 comprises several sub-systems which together provide sufficient calorific energy to raise the exhaust temperature of the filter 26 to a level required to maintain stable and efficient combustion of the particulates thereon. Burner apparatus 28 comprises a fuel injector nozzle 32 for injecting fuel into the burner during regeneration. A fuel pump 38 supplies fuel to nozzle 32. The air required for complete combustion of the fuel entering burner apparatus 28 through nozzle 32 is supplied through two sources. The first, an engine driven, positive displacement air pump 34 provides clean, high oxygen content air to nozzle 32 through air line 35 for atomization of the fuel injected into burner apparatus 28 and for reliable ignition of the mixture by an ignitor 33. In order to minimize the size and complexity of burner apparatus 28, it is desirable to maintain a substantially constant flow rate of combustion air through the burner during the regeneration event regardless of engine operating conditions. Such a flow rate eliminates the need for systems to vary fuel flow in response to wide variations in combustion air flow through the burner. In the present invention, the remainder of the combustion air is supplied to burner apparatus 28 through burner supply conduit 42. The burner supply conduit 42 has an inlet located upstream of diverter valve 18, an outlet connected to burner apparatus 28, and a metering orifice 44 disposed therein. The orifice 44 maintains a substantially constant exhaust flow rate into the burner during regeneration.

Figure 2:
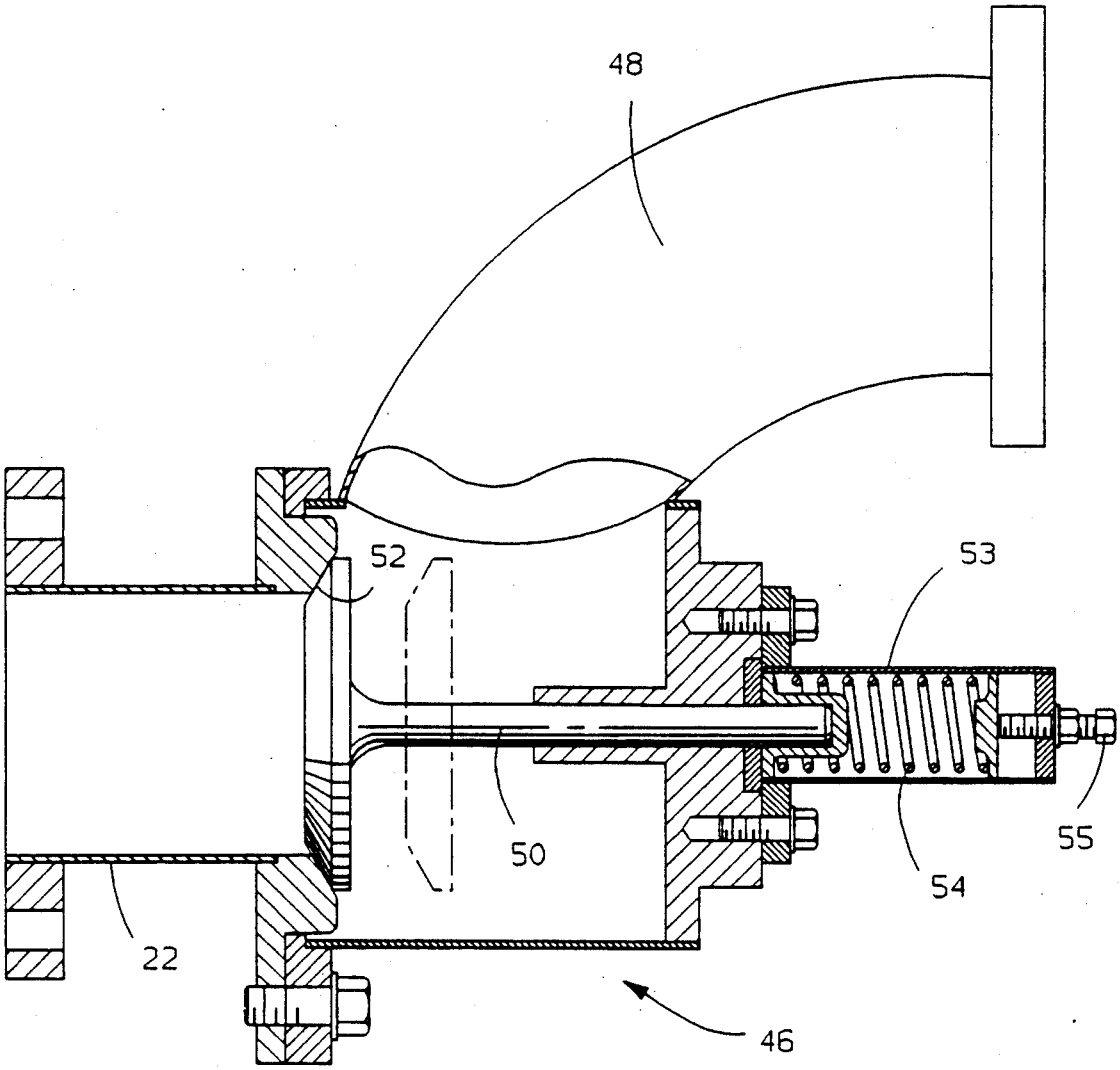
FIG. 2 is a sectional view of one embodiment of a pressure relief valve employed in the exhaust cleaner and burner system of FIG. 1.

The exhaust flow supplied through burner supply conduit 42 enters burner apparatus 28 at inlet 43 where it is mixed with the burning air-fuel mixture in a mixing chamber 31. Subsequently, the hot gas exits burner apparatus 28 through adapter 30 and enters filter canister 24 where it regenerates filter 26. To assure a substantially constant flow rate through metering orifice 44, exhaust gas pressure at the inlet of the orifice must be maintained substantially constant. To this end, a pressure relief valve 46 is disposed within bypass branch 22. The relief valve 46 acts, during regeneration, to close the path of the exhaust gas passing through bypass branch 22 thereby increasing pressure within system 10 upstream of the valve. Once a predetermined pressure is achieved, valve 46 is overcome and exhaust flows freely through bypass system 48 to the atmosphere. Pressure relief valve 46, see FIG. 2, comprises a pintle valve 50, or other suitable valve, which is held in a normally closed position against a valve seat 52 by means of a force applied by a biasing means such as spring 54 whose biasing force is adjustable by screw 55. The location of pintle valve 50 in the exhaust stream of bypass system 48 results in high temperatures within the entire relief valve assembly 46. Of particular importance is spring 54 which, when subjected to repeated temperature extremes may be damaged. As an example, a change in spring rate may occur, which is detrimental to the maintenance of the desired pressure. To reduce temperatures experienced by the spring 54, cooling air supplied by air pump 34 may be circulated through spring housing 53.

In order to maintain efficient, reliable operation of burner apparatus 28, various components, namely the fuel injector nozzle 32 and pressure sensor tube 21*a*, must remain free of particulates and other contamination. Purge air solenoids 57 and 59 supply purge air, from air pump 34 to fuel nozzle 32 and sensor tube 21*a*, respectively. Following a regeneration event, ECM 19 switches solenoid 57 from fuel supply to air supply thereby purging both fuel pump 38 and fuel injector nozzle 32 of fuel. Purge air continues to flow through pump 38 and nozzle 32 until a subsequent regeneration event to prevent soot build-up on nozzle 32. Similarly, purge air solenoid 59 is periodically switched to air supply to purge sensor tube 21*a* thereby preventing particulates entering filter canister 24 from clogging the tube, resulting in improper readings from pressure sensor 21.

Control of exhaust cleaner and burner system 10 is through ECM 19 and Electronic Ignition Unit (EIU) 19*a*, or other suitable microprocessor based controls. The ECM 19 monitors pressure at the entrance of filter 26 through pressure sensor 21 and, upon sensing a predetermined pressure, initiates regeneration. Solenoid valve 23 is switched to operate actuator 17 and close bypass valve 18. As a result, exhaust gas is channeled through bypass branch 22 with a substantially constant pressure maintained at the inlet to metering orifice 44 by pressure relief valve 46 disposed therein. Simultaneously, solenoid 57 is switched to supply fuel to fuel pump 38 and fuel injector nozzle 32. The fuel, under pressure from pump 38, is injected by nozzle 32 into burner apparatus 28 where it is atomized by air entering through air line 35. Ignitor 33 is energized by EIU 19*a*, through an ignition coil 36, to ignite the air-fuel mixture The burning mixture is combined with metered exhaust gas entering mixing chamber 31 through burner supply conduit 42 and the heated gas passes through adapter 30 and into canister 24 where particulates trapped by filter 26 are combusted by the heated gas. A flame sensor 61, disposed in canister 24, is monitored by EIU 19*a* to assure proper ignition of the air fuel mixture within burner apparatus 28.

In order to assure proper atomization of fuel entering burner 28, the air pressure within air line 35 must be maintained constant, relative to pressure at the inlet to filter 26. Differential pressure sensor 63, compares pressure at the inlet to filter 26 with pressure in air line 35. The sensor 63 is monitored by ECM 19 which varies pressure in line 35, through an air pressure regulator 65, in the event of a pressure differential change as occurs during regeneration of the particulates in filter 26. Once pressure, as measured by sensor 21 reaches a desired level, indicative of a clean filter, the ECM 19 ends the regeneration event. Solenoid valve 23 is switched to operate actuator 17 to open bypass valve 18. Simultaneously, purge air solenoid 57 is switched to supply purge air to fuel pump 38 and fuel injector nozzle 32. Full exhaust gas flow is now channeled through main branch 20 where it enters adapter 30, canister 24, and passes through filter 26 where particulates are removed.

As noted above, it is desirable to maintain a substantially constant gas flow through burner apparatus 28 during the regeneration event so as to eliminate the need to vary fuel flow based on widely varying changes in gas flow. To achieve the desired flow, it is desirable to maintain a constant ratio between the pressure at the entrance to filter 26 and the pressure within burner supply conduit 42 which is maintained, during regeneration, by pressure relief valve 46. Since the amount of pressure at the entrance to filter 26 will gradually decrease during regeneration due to the combustion of particulates, it would be desirable to vary the pressure within conduit 42 as this occurs, to maintain the desired pressure ratio thereby assuring efficient burner operation.

Figure 3:
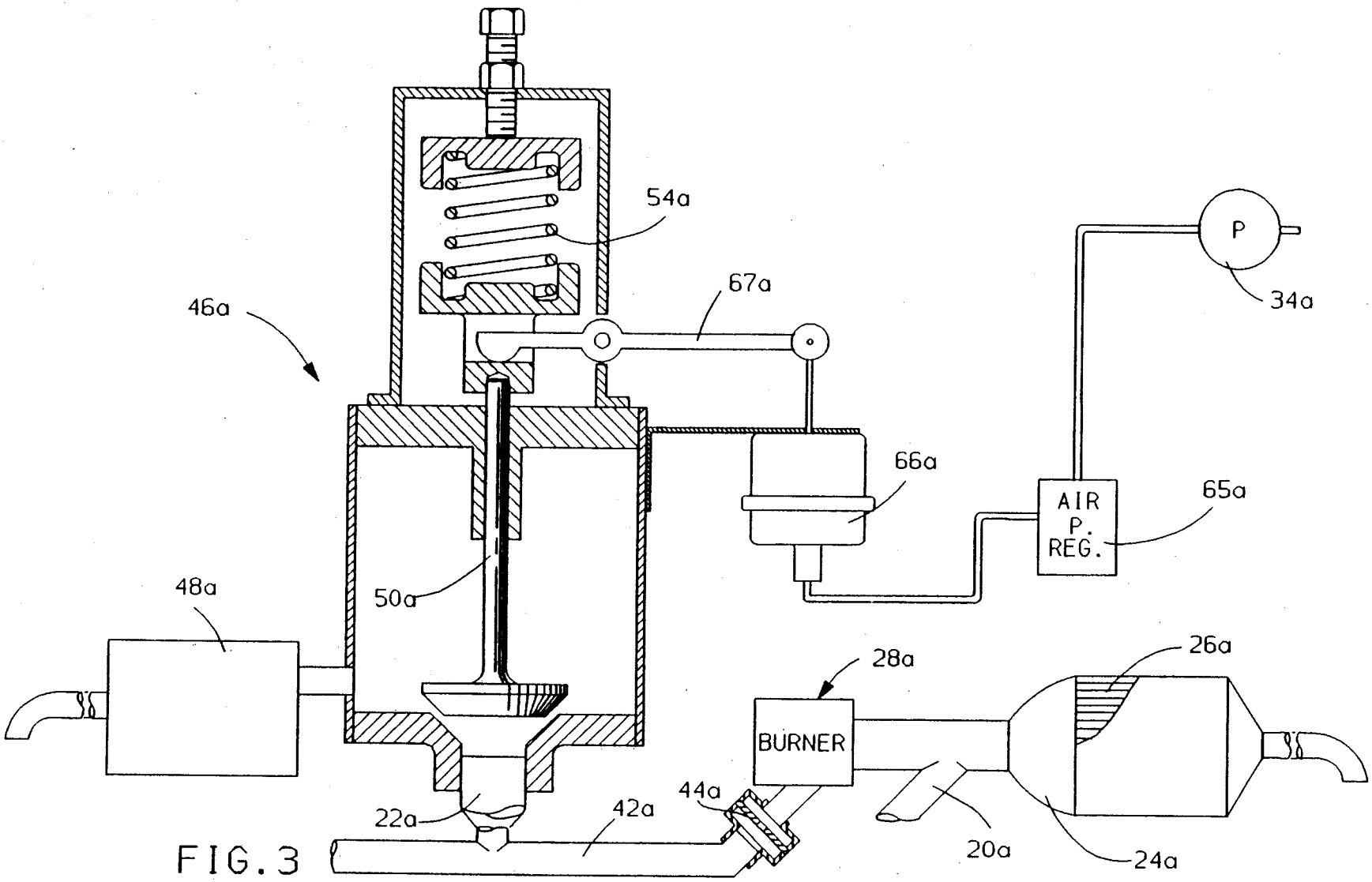
FIG. 3 is a simplified partial schematic view of a second embodiment of the exhaust cleaner and burner system of the present invention in which an adjustable pressure relief valve is employed.

A second embodiment of the above invention is shown in FIG. 3. Many of the components illustrated in FIG. 3 are similar to corresponding components described above and shown in FIGS. 1 and 2. The corresponding components in FIG. 3 have been given similar designation numbers with the addition of an "a". The second embodiment discloses an apparatus for varying the operation of pressure relief valve 46*a* comprising an actuator 66*a* which acts through linkage 67*a* to exert a force on valve 50*a* which supplements the force exerted by spring 54*a*. Actuator 66*a* is operated by air pressure from air pump 34*a* which is varied, by pressure regulator 65*a*, based on the pressure at the entrance to filter 26*a*. As a result, the desired ratio between the pressure in the burner supply conduit 42*a* and the pressure at the entrance to the filter 26*a* is maintained, resulting in optimum efficiency of the burner apparatus 28*a*.

Figure 4:
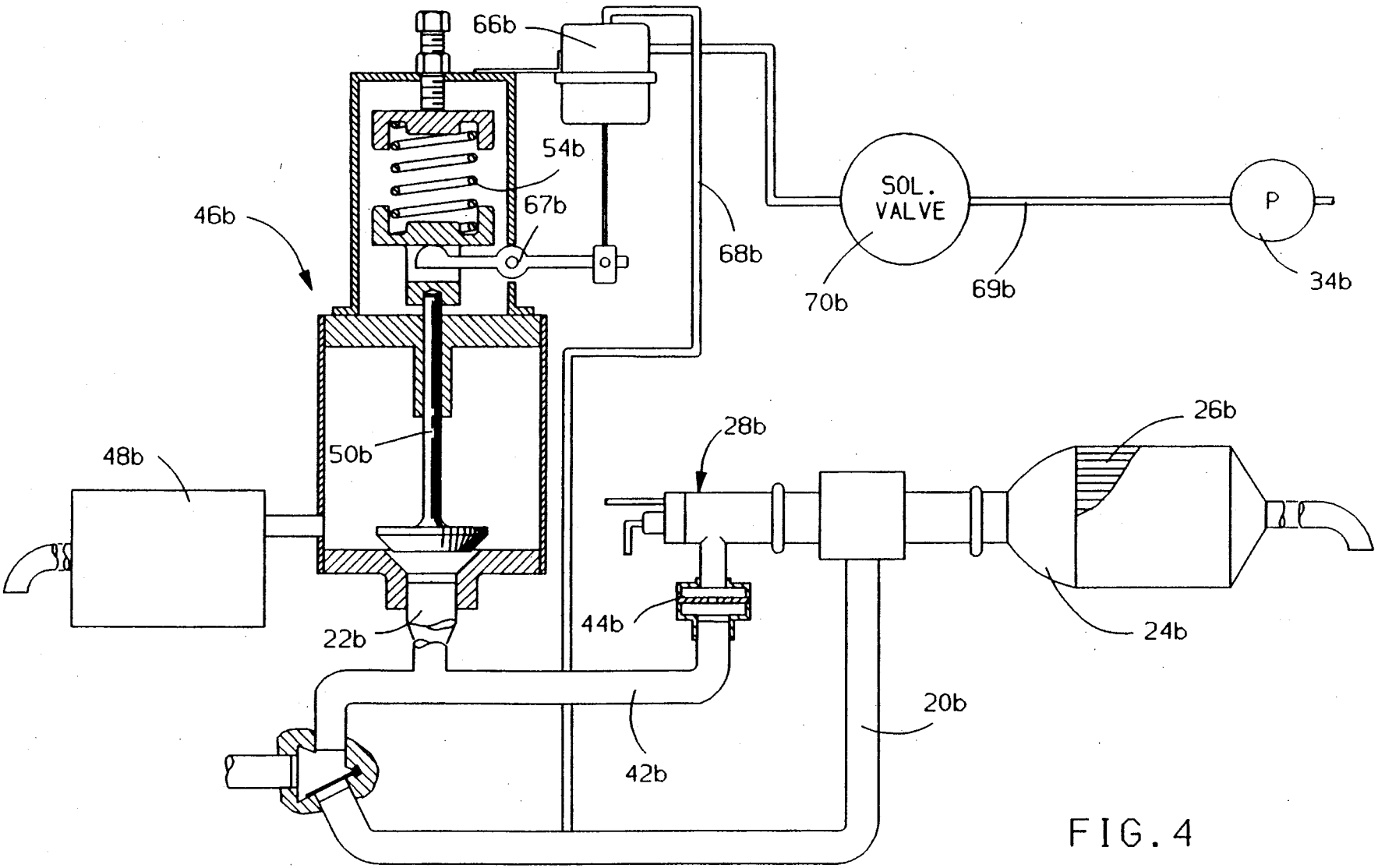
FIG. 4 is a simplified partial schematic view of a third embodiment of the exhaust cleaner and burner system of the present invention in which an adjustable pressure relief valve is employed.

Similarly, a third embodiment of the invention, shown in FIG. 4 varies the operation of pressure relief valve 46*b* using an actuator 66*b* which is similar to that described above. As noted above, corresponding components in FIG. 4 have been given similar designation numbers but with the addition of a "b". In this embodiment, the actuator 66*b* is acted on directly by the pressure at the entrance to filter 26*b* through connection 68*b*. As the pressure varies, during the regeneration event, the pressure in connection 68*b* changes the force applied by spring 54*b* through linkage 67*b*. As a result, pressure in the burner supply conduit 42*b* is maintained at a constant ratio relative to the pressure at the entrance of filter 26*b*. Because the connection 68*b* is tied directly to the exhaust conduit, it is subject to becoming clogged by exhaust particulates. To prevent clogging of connection 68*b*, purge air from air pump 34*b* is supplied to actuator 66*b*, through purge air line 69*b*. During normal operation, solenoid 70*b* opens to allow purge air to flow through actuator 66*b* and connection 68*b* preventing particulate build-up therein.

The exhaust cleaner and burner system 10 of the present invention is an efficient solution to the regeneration of particulate filters used with internal combustion engines, namely diesel engines Through the use of an orifice metered exhaust gas supply conduit, and a pressure relief valve for maintaining substantially constant pressure at the entrance to the conduit, substantially constant combustion air flow can be assured through the burner apparatus. As a result, the need for varying burner operation dependent upon wide variations in engine speed and load is eliminated.

Additionally, the use of a bypass system for a substantial portion of engine exhaust during regeneration, dispenses with the need to heat the entire exhaust flow during regeneration. As a result, a smaller, more efficient fuel-air burner system may be used.

While certain embodiments of the invention have been described in detail above in relation to an exhaust cleaner and burner system, it would be apparent to those skilled in the art that the disclosed embodiment may be modified. Therefore, the foregoing description is to be considered exemplary, rather than limiting, and the true scope of the invention is that described in the following claims.

The embodiments of the invention in which an exclusive property or privilege is claimed are defined as follows:

1. An exhaust cleaner and burner system for use with the exhaust system of an internal combustion engine comprising:

an exhaust conduit for receiving exhaust gas from the engine, having an inlet and an outlet;

a diverter valve disposed at said outlet for selectively directing exhaust flow through a first, main branch when open and a second, bypass branch when closed;

exhaust filter means having an inlet connected to said main branch and an outlet connected to the exhaust system;

burner means having an outlet mounted upstream of said filter means and operable to raise the temperature of said filter means, said burner means comprising a burner supply conduit for supplying exhaust gas to said burner, said burner supply conduit having an inlet end connected to said exhaust conduit, an outlet end connected to said burner means and a metering orifice disposed within said burner supply conduit, between said inlet end and said outlet end;

said system operable, during normal engine operation, to open said diverter valve and pass exhaust gas through said filter means, and operable, upon reaching a predetermined condition, to close said diverter valve and pass exhaust gas through said bypass branch and means for maintaining a predetermined pressure in said exhaust conduit to provide a substantially constant supply of exhaust gas to said burner means through said burner supply conduit; and wherein said burner means is operable to raise the temperature of said exhaust gas to a level sufficient to burn particulates accumulated on said filter thereby regenerating said filter.

2. An exhaust cleaner and burner system for use with the exhaust system of an internal combustion engine comprising:

an exhaust conduit for receiving exhaust gas from the engine, having an inlet and an outlet;

a diverter valve disposed at said outlet for selectively directing exhaust flow through a main branch when open and a bypass branch when closed;

exhaust filter means having an inlet connected to said main branch and an outlet connected to the exhaust system;

burner means having an outlet mounted upstream of said filter means and operable to raise the temperature of said filter means, said burner means comprising a burner supply conduit for supplying exhaust gas to said burner, said burner supply conduit having an inlet end connected to said exhaust conduit upstream of said diverter valve, an outlet end connected to said burner means and a metering orifice disposed within said burner supply conduit, between said inlet end and said outlet end;

a pressure relief valve operable in said bypass branch to maintain a predetermined pressure upstream of said valve;

said system operable, during normal engine operation, to open said diverter valve and pass exhaust gas through said filter means, and operable, upon reaching a predetermined condition, to close said diverter valve and pass exhaust gas through said bypass branch, wherein a predetermined pressure is maintained in said exhaust conduit by said pressure relief valve, thereby providing a substantially constant supply of exhaust gas to said burner means through said burner supply conduit; and wherein said burner means is operable to raise the temperature of said exhaust gas to a level sufficient to burn particulates accumulated on said filter thereby regenerating said filter.

3. An exhaust cleaner and burner system as defined in claim 2, said exhaust filter means comprising a monolithic filter constructed of porous ceramic.

4. An exhaust cleaner and burner system as defined in claim 2, said burner means further comprising a fuel injector nozzle, a fuel pump for delivery of fuel to said nozzle and an air pump connectable to said fuel pump and said nozzle to purge said fuel pump and said nozzle when said burner is not in operation to prevent fuel leakage into said burner and particulate build-up on said nozzle.

5. An exhaust cleaner and burner system as defined in claim 2, said pressure relief valve comprising a pintle valve, biased to remain closed until a predetermined pressure occurs upstream of said valve.

6. An exhaust cleaner and burner system as defined in claim 5, said pressure relief valve further comprising means for selectively varying said bias.

7. An exhaust cleaner and burner system as defined in claim 2 further comprising control means for monitoring system variables and issuing output commands to regenerate said filter when predetermined conditions are reached.

8. An exhaust cleaner and burner system for use with the exhaust system of an internal combustion engine comprising:

an exhaust conduit for receiving exhaust gas from the engine, having an inlet and an outlet;

a diverter valve disposed at said outlet for selectively directing exhaust flow through a main branch when open and a bypass branch when closed;

an exhaust filter having an inlet connected to said main branch and an outlet connected to the exhaust system;

burner means having an outlet mounted upstream of said filter means and operable to raise the temperature of said filter means, said burner means comprising a burner supply conduit for supplying exhaust gas to said burner, said burner supply conduit having an inlet end connected to said exhaust conduit upstream of said diverter valve, an outlet end connected to said burner means and a metering orifice disposed therein, between said inlet and outlet ends;

a pressure relief valve operable to maintain a predetermined pressure upstream of said valve; and a controller for monitoring system variables and issuing output commands to actuate said diverter valve and burner means to regenerate said filter when predetermined conditions occur;

said system operable, during normal engine operation, to open said diverter valve and pass exhaust gas through said filter means, and operable, upon reaching a predetermined condition to close said diverter valve and pass exhaust gas through said bypass branch, wherein a predetermined pressure is maintained in said exhaust conduit thereby providing a substantially constant flow of exhaust gas to said burner means through said burner supply conduit; and wherein said burner means is operable to raise the temperature of said supply of exhaust gas to a predetermined level sufficient to burn said soot accumulation on said filter thereby regenerating said filter.

* * * * *